US010022858B2

(12) United States Patent
Huang

(10) Patent No.: US 10,022,858 B2
(45) Date of Patent: Jul. 17, 2018

(54) MECHANIC'S CHAIR WITH MOVABLE TRAY

(71) Applicant: HIEVER CO., LTD., Taichung (TW)

(72) Inventor: Tony Huang, Taichung (TW)

(73) Assignee: HIEVER CO., LTD., Taichung (TW)

( * ) Notice: Subject to any disclaimer, the term of this patent is extended or adjusted under 35 U.S.C. 154(b) by 0 days.

(21) Appl. No.: 15/361,728

(22) Filed: Nov. 28, 2016

(65) Prior Publication Data

US 2017/0164751 A1 Jun. 15, 2017

(30) Foreign Application Priority Data

Dec. 15, 2015 (TW) ..... 104220140 U

(51) Int. Cl.
*A47C 7/62* (2006.01)
*B25H 5/00* (2006.01)

(52) U.S. Cl.
CPC *B25H 5/00* (2013.01); *A47C 7/62* (2013.01)

(58) Field of Classification Search
CPC ..... B60N 3/001; B60N 3/002; B25H 5/00; A47C 7/62
USPC ..... 297/188.11
See application file for complete search history.

(56) References Cited

U.S. PATENT DOCUMENTS 4,012,158 A * 3/1977 Harper ..... A47C 7/402 248/408
4,043,592 A * 8/1977 Fries ..... A47C 7/402 297/291
4,373,761 A * 2/1983 Hansberry, Jr. ..... B25H 5/00 182/132
4,925,245 A * 5/1990 Pendleton ..... A47B 85/00 297/111
5,007,678 A * 4/1991 DeKraker ..... A47C 7/402 297/353
5,853,222 A * 12/1998 Roslund, Jr. ..... A47C 7/402 248/297.31
6,050,660 A * 4/2000 Gurley ..... B25H 3/028 280/47.26
6,074,000 A * 6/2000 Wagner ..... A47C 7/62 297/188.08
6,199,877 B1 * 3/2001 Shockley ..... B25H 5/00 280/32.6
6,422,652 B1 * 7/2002 Roslund, Jr. ..... A47C 7/402 297/353
6,793,286 B2 * 9/2004 Burgin ..... A47C 7/402 297/353
7,658,442 B1 * 2/2010 Whiteside ..... A47C 7/62 297/188.01
8,303,040 B2 * 11/2012 Lai ..... B60N 2/4817 297/353
8,844,947 B1 * 9/2014 Whiteside ..... B25H 5/00 280/32.6

(Continued)

*Primary Examiner* — Timothy J Brindley
(74) *Attorney, Agent, or Firm* — Muncy, Geissler, Olds & Lowe, P.C.

(57) ABSTRACT

A mechanic's chair with a movable tray includes a support and a seat pad disposed on the support. The tray is disposed below the seat pad and can be pulled to move and engageably fixed in place such that the distance by which the tray is pulled depends on a user's need for accessing the tray for a tool, and the tray is moved and fixed in place efficiently by an engagement mechanism composed of a lever disposed beside the tray and rails disposed on the support.

12 Claims, 9 Drawing Sheets

(56) References Cited

U.S. PATENT DOCUMENTS

| | | | | |
|---|---|---|---|---|
| 2004/0178589 | A1* | 9/2004 | Grauss | B25H 5/00<br>280/32.6 |
| 2005/0225131 | A1* | 10/2005 | Hynes | A47C 7/62<br>297/188.11 |
| 2008/0258515 | A1* | 10/2008 | Whiteside | A47C 9/00<br>297/174 R |
| 2014/0252819 | A1* | 9/2014 | Andrade | A47C 5/12<br>297/188.04 |
| 2015/0084293 | A1* | 3/2015 | Huang | B25H 5/00<br>280/32.6 |
| 2017/0332784 | A1* | 11/2017 | Huang | A47B 83/02 |

* cited by examiner

MECHANIC'S CHAIR WITH MOVABLE TRAY

BACKGROUND OF THE INVENTION

Field of the Invention

The present invention relates to repair-related auxiliary tools and, more particularly, to a mechanic's chair with a movable tray.

Description of the Prior Art

Commercially-available mechanic's chairs, such as one disclosed in US D353058, are conducive to repairs carried out by auto mechanics and the auto mechanics' access to tools. The mechanic's chairs each essentially comprise a support, a seat pad disposed on the support, a base disposed below the support, rollers mounted on the base from below, and an operating surface defined on top of the base and adapted for tools to be placed on. Due to their aforesaid structural features, not only are the mechanic's chairs easy for users to sit on and move around, but the operating surfaces of the mechanic's chairs are also good places for users to take tools from and put the tools on.

However, the mechanic's chairs still have room for improvement. For instance, to take a tool from, and put the tool on, the rear of the operating surface, users have to bend their bodies further in order for their hands to reach the rear of the operating surface.

SUMMARY OF THE INVENTION

It is an objective of the present invention to provide a mechanic's chair with a movable tray such that users can take a tool from, and put the tool on, the tray conveniently because of movability thereof.

In order to achieve the above and other objectives, the present invention provides a mechanic's chair with a movable tray, characterized in that the tray, which is disposed below a seat pad of a support of the mechanic's chair, can be pulled to move and engageably fixed in place such that the distance by which the tray is pulled depends on a user's need for accessing the tray for a tool, and the tray is moved and fixed in place efficiently by an engagement mechanism composed of a lever and rails connected thereto.

DETAILED DESCRIPTION OF THE EMBODIMENT OF THE INVENTION

Figure 1:
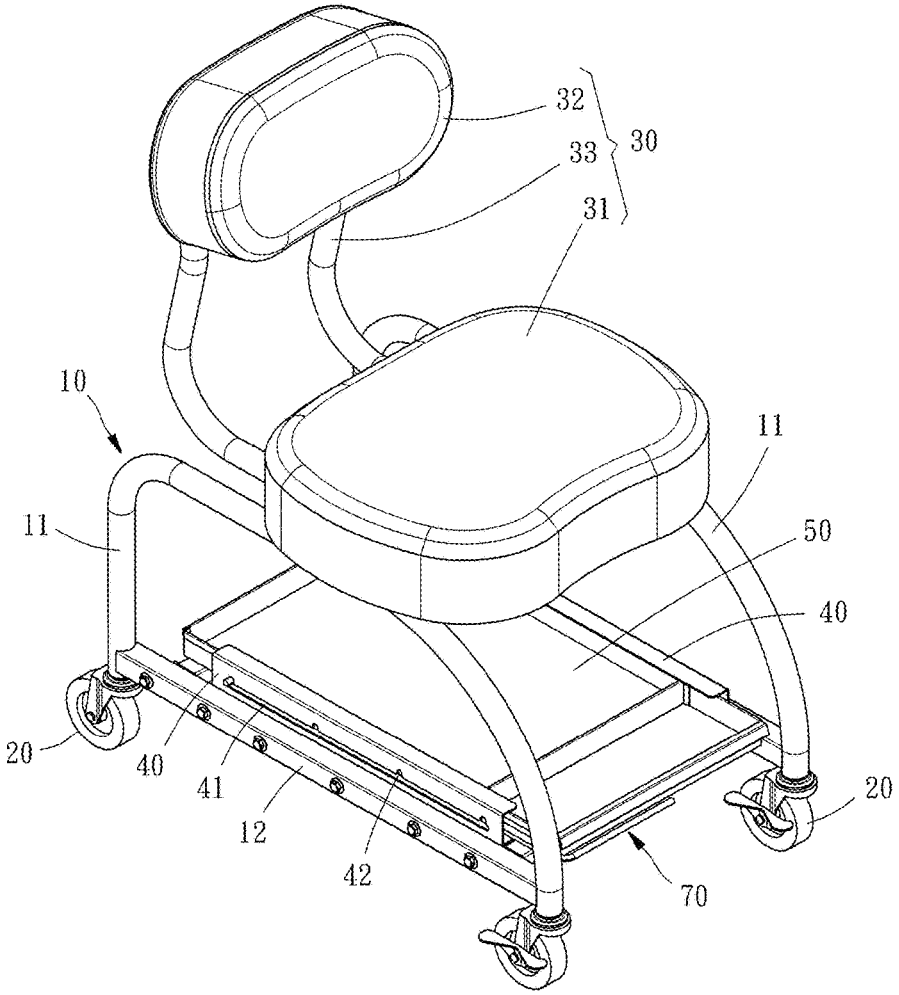
FIG. 1 is a perspective view of a mechanic's chair with a movable tray according to the first embodiment of the present invention.
Figure 2:
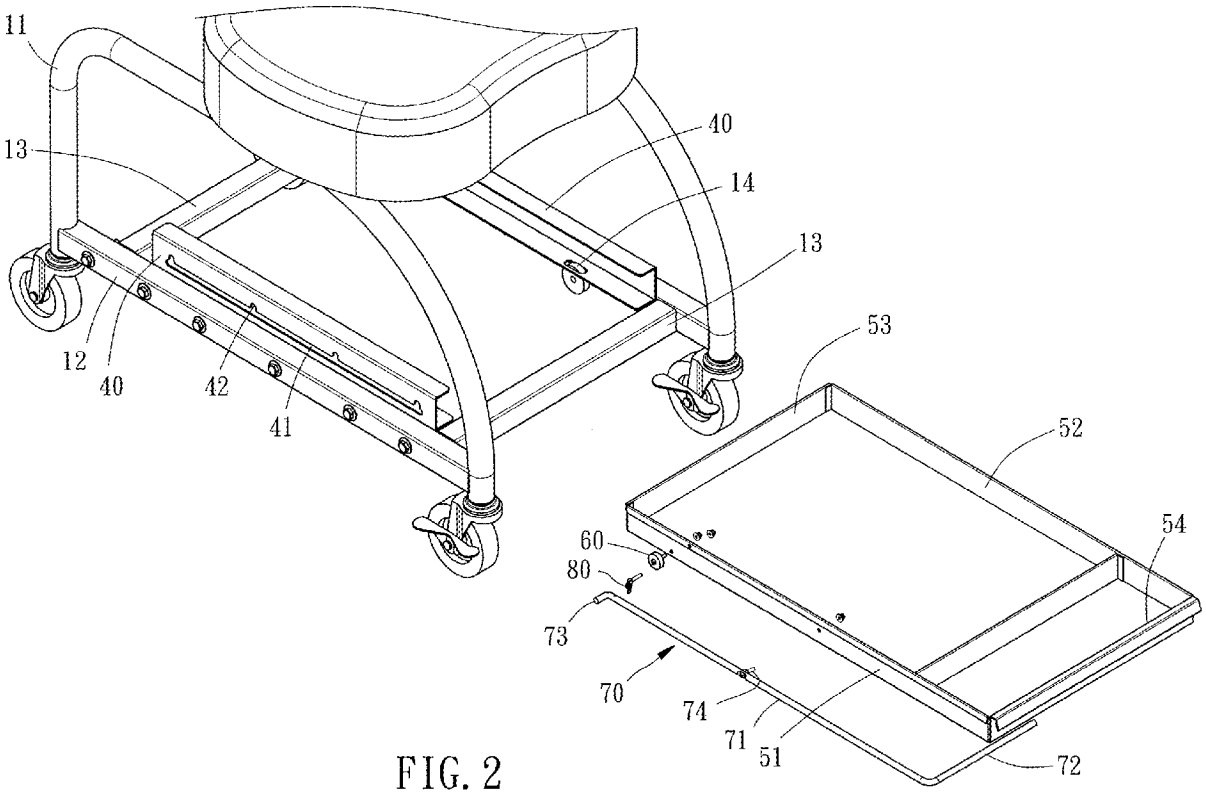
FIG. 2 is a partial exploded view of the mechanic's chair with a movable tray according to the first embodiment of the present invention.
Figure 3:
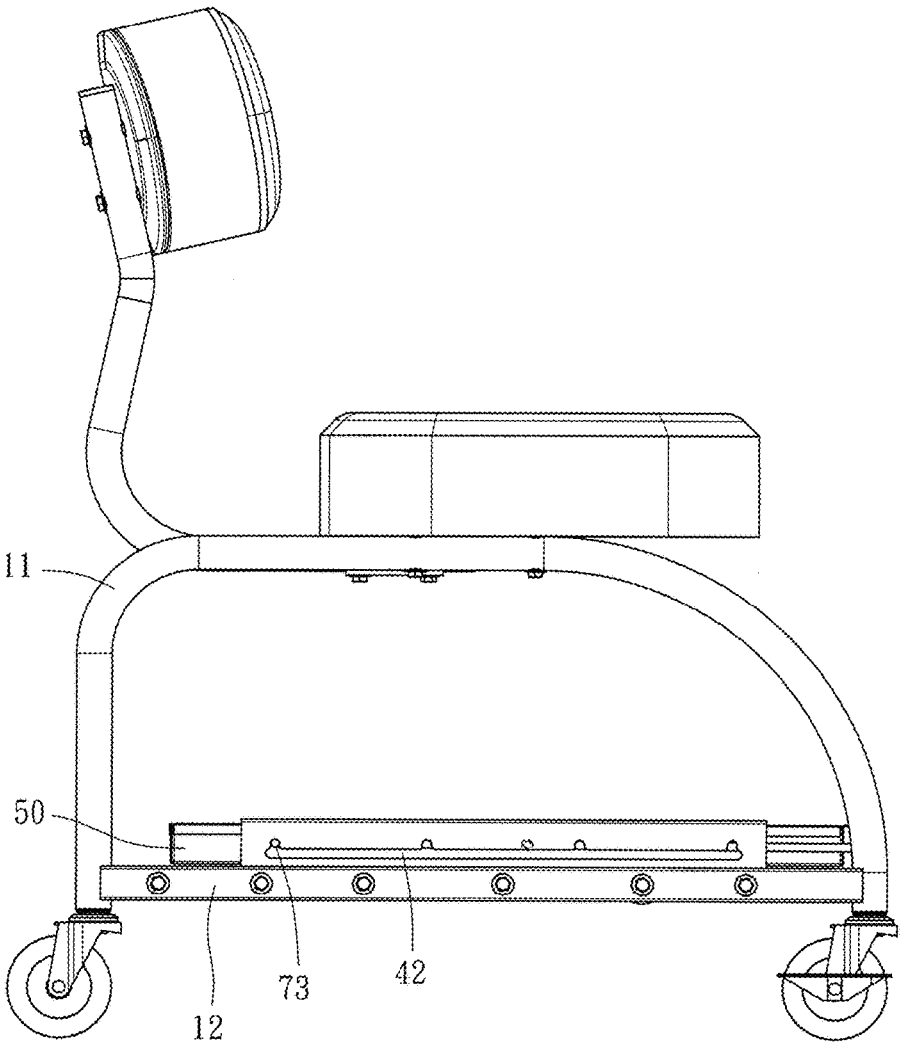
FIG. 3 is a lateral view of the mechanic's chair with a movable tray according to the first embodiment of the present invention, showing that the tray is located at the innermost position.
Figure 4:
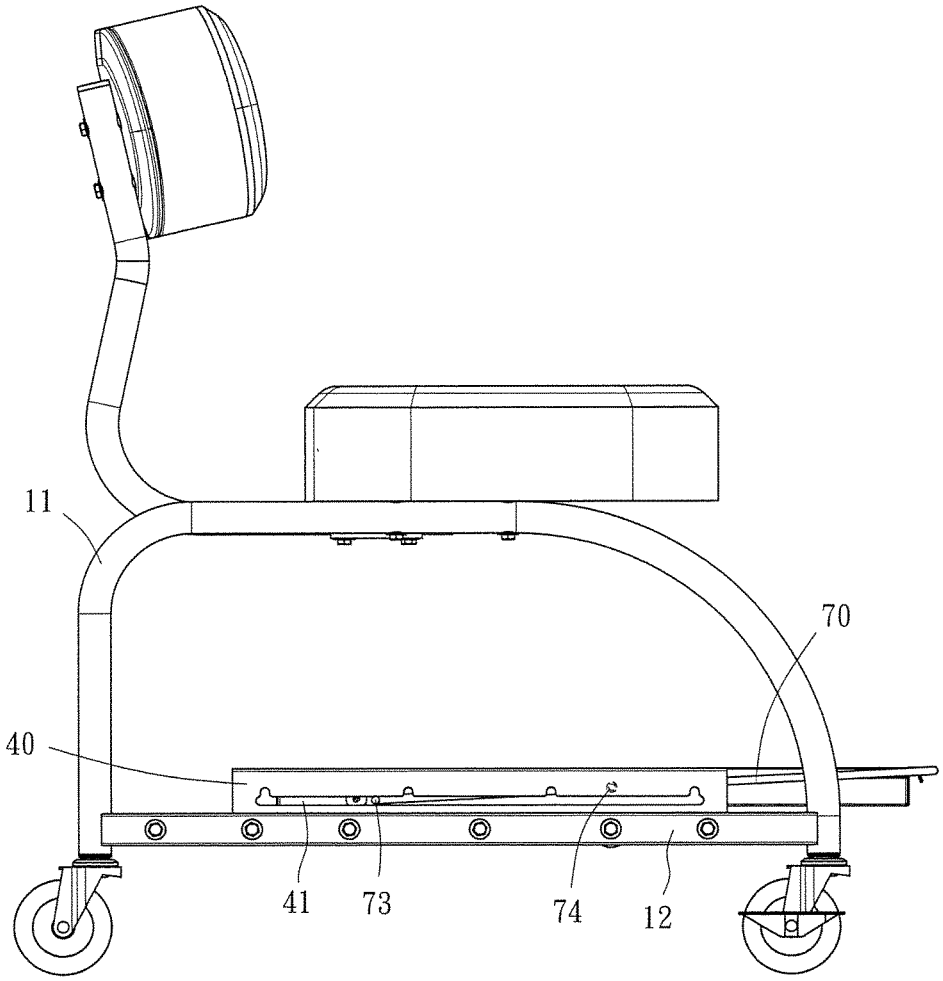
FIG. 4 is a lateral view of the mechanic's chair with a movable tray according to the first embodiment of the present invention, showing that the lever is pulled upward to disconnect the fastening end from one of the holes.

Referring to FIG. 1 through FIG. 5, a mechanic's chair with a movable tray in the first embodiment of the present invention comprises a support (10), four wheels (20), a seat pad unit (30), two rails (40), a tray (50), two rollers (60), a lever (70), and a spring (80).

The support (10) has two upper rods (11). A lateral rod (12) is disposed between the two ends of each upper rod (11). Two transverse rods (13) are disposed between the two lateral rods (12).

The four wheels (20) are disposed at the bottom of the support (10) such that the support (10) is movable with the wheels (20). The wheels (20) are not necessarily in the number of four, but can also be in the number of three or five as needed.

The seat pad unit (30) comprises a seat pad (31) and a backrest (32). The seat pad (31) is disposed between the two upper rods (11). The backrest (32) is connected to an edge of the seat pad (31) by two connecting rods (33).

The two rails (40) are disposed at the two lateral rods (12) and extended along the axes of the two lateral rods (12), respectively. One of the rails (40) has a groove (41). The groove (41) is disposed along the axis of the rail (40). A plurality of holes (42) is disposed beside the groove (41). Each hole (42) is in communication with the groove (41).

The tray (50) is rectangular and thus has two long sides (51)(52) and two short sides (53)(54). The short side (53) of the tray (50) is penetratingly disposed between the two rails (40) and is movable along the axes of the two rails (40).

The two rollers (60) are disposed on the two long sides (51)(52) of the tray (50) and roll along the two rails (40), respectively. Due to the rolling of the two rollers (60), the motion of the tray (50) along the axes of the two rails (40) is smooth.

The lever (70) is disposed pivotally at the long side (51) of the tray (50) and disposed between the tray (50) and the rails (40). The lever (70) has a body portion (71), a pulling end (72), and a fastening end (73). The body portion (71) of the lever (70) is pivotally disposed on the long side (51) of the tray (50) by a bolt (74). The fastening end (73) is penetratingly disposed at the groove (41) and engaged with the holes (42) beside the groove (41). The pulling end (72) is extended from the body portion (71) so as to be disposed outward of the short side (54) of the tray (50).

The spring (80) is disposed on the long side (51) of the tray (50). One end of the spring (80) is fixed to the tray (50). The other end of the spring (80) is hooked up to the body portion (71) and positioned proximate to the fastening end (73). The spring (80) is capable of exerting upon the fastening end (73) a tensile force required for the fastening end (73) to restore the position thereof after a displacement.

Hence, under the tensile force exerted by the spring (80), the fastening end (73) becomes engaged with the holes (42) beside the groove (41).

Figure 5:
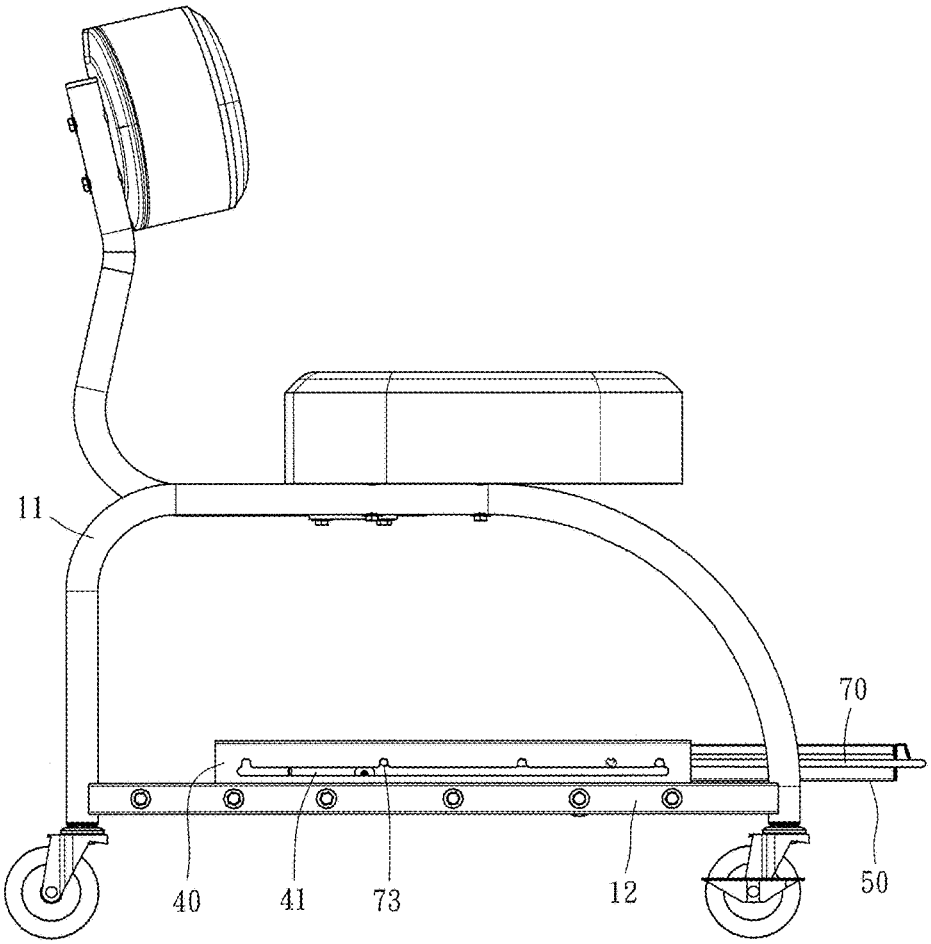
FIG. 5 is a lateral view of the mechanic's chair with a movable tray according to the first embodiment of the present invention, showing that the tray is positioned at another position.

Given the aforesaid structure of the mechanic's chair with a movable tray according to the first embodiment of the present invention, a user can sit on the seat pad (31) to perform a repair, with the tray (50) holding tools for use by the user. To take the tools from the tray (50), the user pulls and lifts the pulling end (72) of the lever (70) such that the fastening end (73) of the lever (70) moves downward to get disconnected from one of the holes (42), and then the user pulls the tray (50) out, as shown in FIG. 5. After being disconnected from the holes (42), the fastening end (73) of the lever (70) ends up in the groove (41) and moves forward together with the tray (50). The forward motion of the fastening end (73) pauses as soon as the fastening end (73) reaches the next hole (42), because the fastening end (73) becomes engaged with the next hole (42) under the tensile force exerted by the spring (80); hence, the tray (50) is prevented from moving continuously. Therefore, any tools placed at the rear of the tray (50) get closer to the user and thus become readily accessible to the user, because of the forward motion of the tray (50). As a result, the user need not bend his or her body very much in order to take any tools placed at the rear of the tray (50), thereby enhancing the ease of use of the tray (50).

To allow the tray (50) to be moved smoothly, a supporting wheel (14) is pivotally disposed inward of the two lateral rods (12) and below the two rails (40). The two supporting wheels (14) underpin the tray (50). The joint operation of the two supporting wheels (14) and the two rollers (60) renders the motion of the tray (50) smooth.

Figure 6:
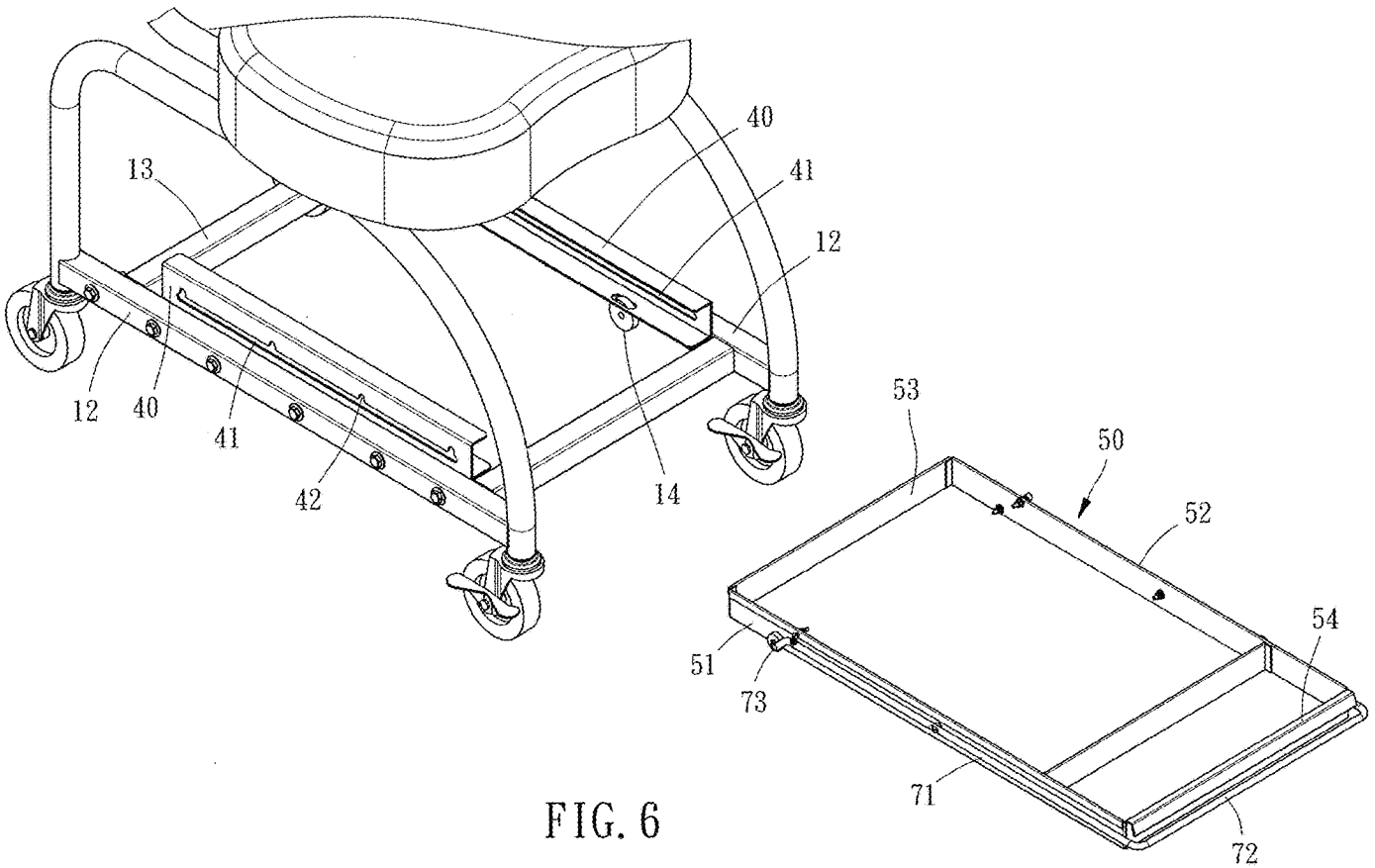
FIG. 6 is a partial exploded view of the mechanic's chair with a movable tray according to the second embodiment of the present invention.
Figure 7:
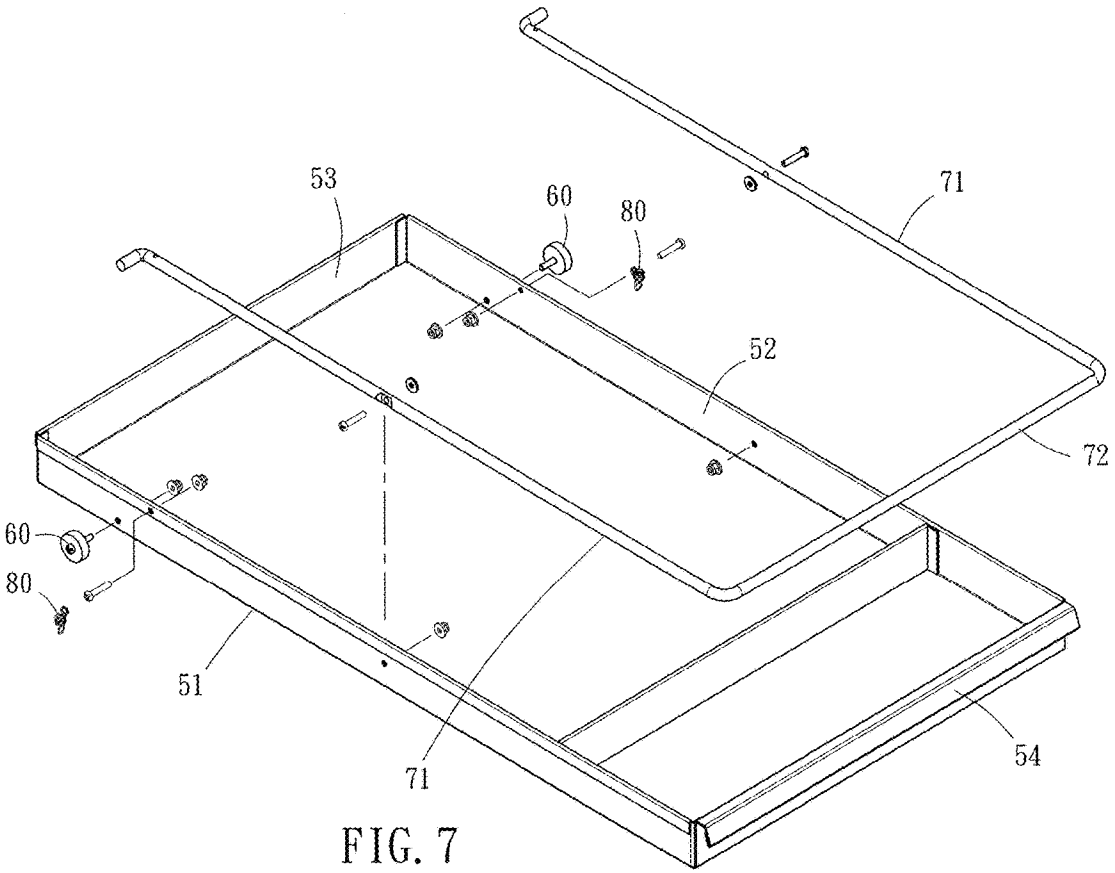
FIG. 7 is an exploded view of the tray according to the second embodiment of the present invention.

Referring to FIG. 6 and FIG. 7, the second embodiment of the present invention is distinguished from the first embodiment of the present invention by a groove (41) disposed at each of the two rails (40), with a plurality of holes (42) disposed beside the groove (41), allowing each hole (42) to be in communication with the groove (41).

The lever (70) has a pulling end (72). A body portion (71) is disposed at each of the two ends of the pulling end (72). Each body portion (71) extends to form a fastening end (73). The two body portions (71) of the lever (70) are pivotally disposed on the two long sides (51)(52) of the tray (50) by two bolts (74), respectively. The two body portions (71) of the lever (70) are disposed between the tray (50) and the respective rails (40). The fastening ends (73) are penetratingly disposed at the grooves (41) of the rails (40) and engaged with the holes (42) beside the grooves (41), respectively. The pulling end (72) is disposed outward of the short side (54) of the tray (50).

The two springs (80) are disposed on the long sides (51)(52) of the tray (50), respectively. One end of each spring (80) is fixed to the tray (50). The other end of each spring (80) is hooked up to the body portion (71) and positioned proximate to the fastening end (73). The springs (80) are capable of exerting upon the fastening ends (73) a tensile force required for the fastening ends (73) to restore positions thereof after a displacement. Hence, under the tensile force exerted by the springs (80), the fastening ends (73) become engaged with the holes (42) beside the grooves (41), respectively.

The second embodiment of the present invention is distinguished from the first embodiment of the present invention in that: the grooves (41) and the holes (42) are disposed on the two rails (40), respectively; the two fastening ends (73) of the lever (70) are penetratingly disposed at the two grooves (41), respectively; the aforesaid symmetrical motions and securing structure together render the motion of the tray (50) smooth and render the engagement firm.

Figure 8:
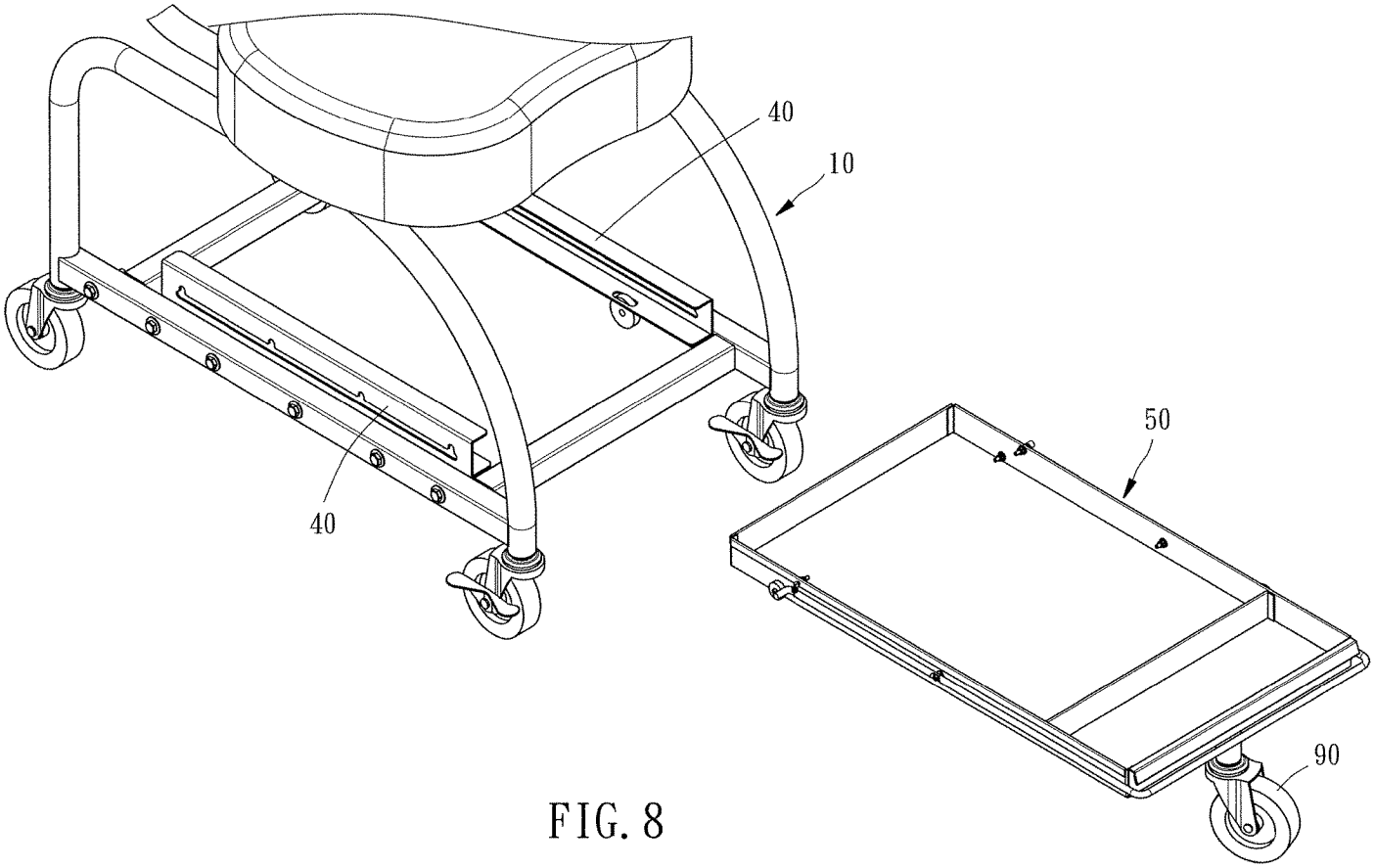
FIG. 8 is a partial exploded view of the mechanic's chair with a movable tray according to the third embodiment of the present invention.

Referring to FIG. 8, the third embodiment of the present invention is distinguished from the second embodiment of the present invention by a wheel (90) disposed below the short side (54) of the tray (50) such that, after being pulled forward and protruded, the tray (50) is strongly supported and thus can bear heavy weight.

Figure 9:
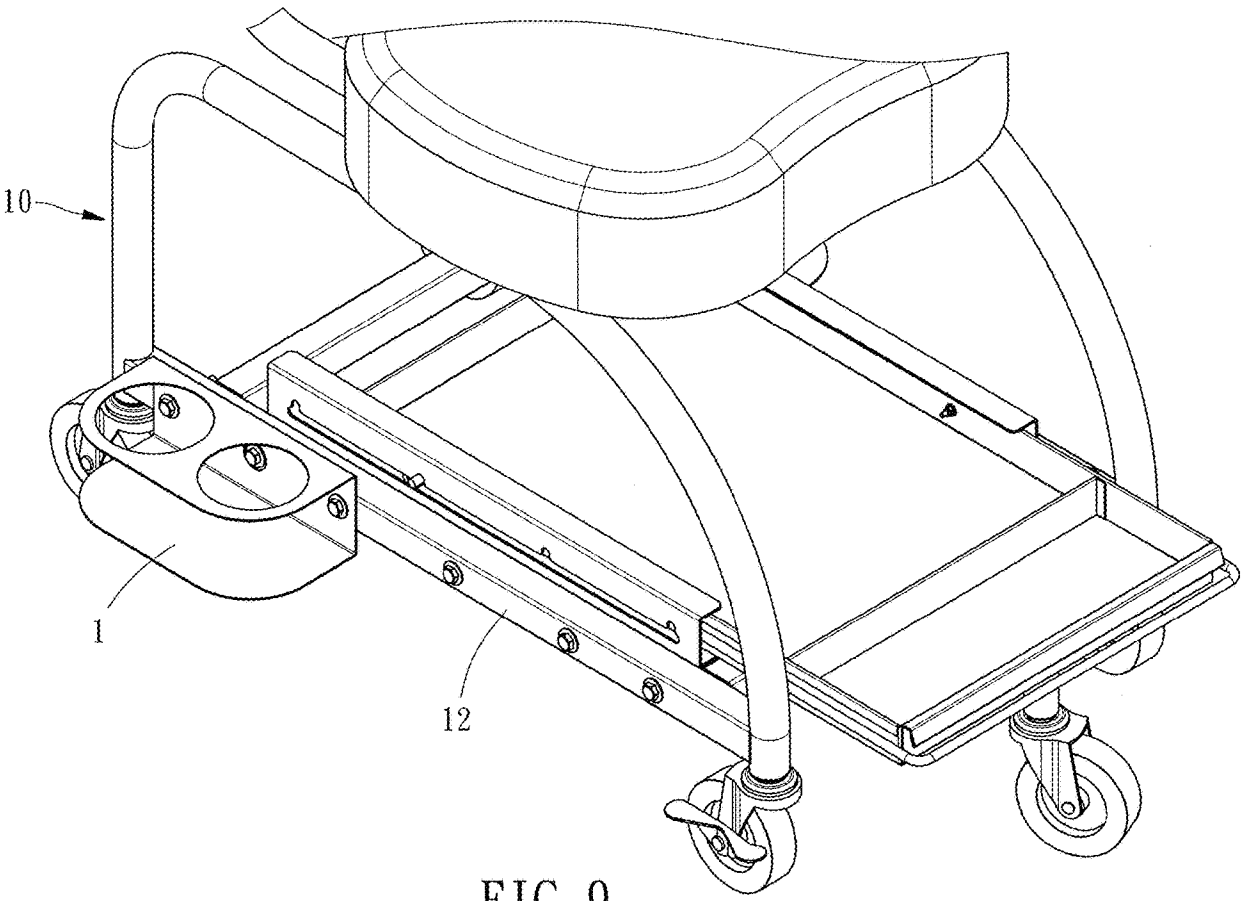
FIG. 9 is a perspective view of the mechanic's chair with a movable tray according to the third embodiment of the present invention, showing that the mechanic's chair is equipped with a holder.

Referring to FIG. 9, a holder (1) is disposed outward of one of the lateral rods (12) and adapted to hold a lubricant oil can and a paint can. The holder (1) is screwed to the lateral rod (12) with a bolt and can be dismounted, mounted or moved as needed.

What is claimed is:

1. A mechanic's chair with a movable tray, comprising:

a support having two lateral rods;

four wheels disposed at a bottom of the support to render the support movable;

a seat pad unit disposed on the support and having a seat pad;

two rails disposed at the two lateral rods, respectively, with a groove disposed at one of the rails and along an axis of the rail, wherein a plurality of holes is disposed beside the groove, and each said hole is in communication with the groove;

a tray penetratingly disposed between the two rails and movable along the two rails;

a lever disposed pivotally at a side of the tray and having a body portion, the body portion having two ends extending to form a fastening end and a pulling end, respectively, with the fastening end penetratingly disposed at the groove and engaged with the holes beside the groove, and the pulling end extendingly disposed on a side of the tray; and a spring disposed on a side of the tray, the spring having an end fixed to the tray and another end hooked up to the body portion and positioned proximate to the fastening end, wherein the spring exerts upon the fastening end a tensile force required for the fastening end to restore a position thereof after a displacement such that, under the tensile force exerted by the spring, the fastening end becomes engaged with the holes beside the groove, wherein a supporting wheel is pivotally disposed inward of each said lateral rod to underpin the tray.

2. The mechanic's chair with a movable tray of claim 1, wherein the lever is pivotally disposed on a side of the tray and between the tray and the rails.

3. The mechanic's chair with a movable tray of claim 1, further comprising two rollers disposed on two sides of the tray to roll along the rails, respectively.

4. The mechanic's chair with a movable tray of claim 2, further comprising two rollers disposed on two sides of the tray to roll along the rails, respectively.

5. The mechanic's chair with a movable tray of claim 1, wherein a tray wheel is disposed below the tray.

6. The mechanic's chair with a movable tray of claim 3, wherein a tray wheel is disposed below the tray.

7. A mechanic's chair with a movable tray, comprising:

a support having two lateral rods;

four wheels disposed at a bottom of the support to render the support movable;

a seat pad unit disposed on the support and having a seat pad;

two rails disposed at the two lateral rods, respectively, with a groove disposed at each said rail and along an axis thereof, wherein a plurality of holes is disposed beside the groove, and each said hole is in communication with the groove;

a tray penetratingly disposed between the two rails and movable along the two rails;

a lever having a pulling end with two ends each extended to form a body portion, each said body portion extending to form a fastening end, the two body portions being pivotally disposed on two sides of the tray, respectively, the fastening ends being penetratingly disposed at the grooves of the rails and engaged with the holes, respectively; and two springs disposed on two sides of the tray, respectively, each said spring having an end fixed to the tray and another end hooked up to the body portion and positioned proximate to the fastening end, wherein the springs exert upon the fastening ends a tensile force required for the fastening ends to restore positions thereof after a displacement such that, under the tensile force exerted by the springs, the fastening ends become engaged with the holes beside the grooves, wherein a supporting wheel is pivotally disposed inward of each said lateral rod to underpin the tray.

8. The mechanic's chair with a movable tray of claim 7, wherein the lever is pivotally disposed on a side of the tray and between the tray and the rails.

9. The mechanic's chair with a movable tray of claim 7, further comprising two rollers disposed on two sides of the tray to roll along the rails, respectively.

10. The mechanic's chair with a movable tray of claim 8, further comprising two rollers disposed on two sides of the tray to roll along the rails, respectively.

11. The mechanic's chair with a movable tray of claim 7, wherein a wheel is disposed below the tray.

12. The mechanic's chair with a movable tray of claim 9, wherein a wheel is disposed below the tray.

* * * * *